United States Patent [19]

Olson

[11] 3,935,713

[45] Feb. 3, 1976

[54] METHOD AND APPARATUS FOR MAINTAINING AND SERVICING A PRESSURIZED REFRIGERATION SYSTEM OR THE LIKE

[75] Inventor: John W. Olson, Oklahoma City, Okla.

[73] Assignee: C & D Valve Manufacturing Company, Oklahoma City, Okla.

[22] Filed: Feb. 26, 1975

[21] Appl. No.: 553,446

Related U.S. Application Data

[60] Division of Ser. No. 378,920, July 13, 1973, Pat. No. 3,840,967, and a continuation-in-part of Ser. No. 484,298, June 28, 1974, Pat. No. 3,875,756, and a continuation-in-part of Ser. No. 343,512, March 21, 1973, abandoned.

[52] U.S. Cl. ..... 62/77; 62/292; 29/213 E

[51] Int. Cl.[2] ..... F25B 45/00

[58] Field of Search ..... 62/77, 292; 29/213

[56] References Cited

UNITED STATES PATENTS

| | | | |
|---|---|---|---|
| 3,252,475 | 5/1966 | Jones | 62/292 |
| 3,299,648 | 1/1967 | White et al. | 62/77 |

*Primary Examiner*—William E. Wayner

*Attorney, Agent, or Firm*—Laney, Dougherty, Hessin & Fish

[57] ABSTRACT

A tool for maintaining and servicing a pressurized refrigeration system or the like wherein it is desirable to remove and replace a threaded check valve core without depressurizing the system. The tool includes a body member having a longitudinal passageway extending therethrough with means to provide sealing communication between one end of the passageway with the fitting in which the check valve is fitted. A removable cap sealingly engages the opposite end of the longitudinal passageway with an operating shaft extending therethrough for axial and rotary movement within the passageway. An annular sliding seal is disposed between the shaft and the removable cap. The shaft includes engaging means formed on one end thereof for releasably engaging the valve core to unthread and remove it from the fitting and withdraw it into the passageway to a position adjacent to the removable cap. A shut-off valve is mounted in the body member to alternately close and open the passageway when the valve core is withdrawn into the passageway adjacent to the cap. An additional port in the body member communicating with the passageway is also disclosed for evacuating or charging the refrigeration system through the passageway. Also disclosed is apparatus for use with the tool for providing initial access into a previously sealed pressurized refrigeration system through the fitting prior to installation of the threaded check valve core therein. A method for removing and replacing the valve core employing the tool is also disclosed.

18 Claims, 10 Drawing Figures

METHOD AND APPARATUS FOR MAINTAINING AND SERVICING A PRESSURIZED REFRIGERATION SYSTEM OR THE LIKE

CROSS-REFERENCE TO RELATED APPLICATIONS

This is a continuation-in-part of application Ser. No. 484,298, filed June 28, 1974, now U.S. Pat. No. 3,875,756 a division of application Ser. No. 378,920, filed July 13, 1973, now U.S. Pat. No. 3,840,967, a continuation-in-part of application Ser. No. 343,512, filed Mar. 21, 1973, now abandoned.

BACKGROUND OF THE INVENTION

1. Field of the Invention

The present invention relates generally to method and apparatus for maintaining and servicing a pressurized system such as a refrigeration system or the like, and more particularly, but not by way of limitation, to method and apparatus for removing and replacing a closure member in a pressurized refrigeration system without depressurizing the system.

2. Description of the Prior Art

The prior art contains a number of teachings of servicing tools which provide access to a refrigeration system or the like to evacuate or charge the system. One such tool is disclosed in U.S. Pat. No. 3,299,648, issued to White, et al.

It should be noted, that neither the White tool nor any other known tools permit the removal and replacement of the threaded closure member in a pressurized refrigeration system without depressurizing the system.

It has become common practice in the refrigeration industry to provide access to pressurized refrigeration systems through threaded fittings in which a threaded check valve core is installed. Such threaded check valves are of the type commonly used in automobile tire valve stems and are often referred to as Schrader-type valve cores.

It has been found that the Schrader-type valve cores used in refrigeration systems are not subject to extremely high quality control measures. Approximately 50 percent of the valve cores initially installed in a refrigeration system are found to be incapable of holding the proper operating pressure to permit efficient operation of the refrigeration system. It is, therefore, necessary many times to replace an unsatisfactory valve core after charging a refrigeration system with refrigerant. It is to this industry-wide problem that the method and apparatus of the present invention is directed.

SUMMARY OF THE INVENTION

The present invention contemplates a tool for use in maintaining and servicing a refrigeration system or the like equipped with an access fitting provided with a removable threaded closure member therein. The tool includes a body member having a first end and a second end and having a longitudinal passageway extending therethrough and communicating at the opposite ends thereof with the first and second ends of the body member. Coupling means is carried on the first end of the body member for removably connecting the first end of the body member to the access fitting with one end of the longitudinal passageway in sealing communication with the access fitting. Removable cap means is provided which is securable to the second end of the body member for sealing closure of the opposite end of the longitudinal passageway, and, alternately, for removal from the body member and includes an aperture formed therein substantially coaxial with the longitudinal passageway. An operating shaft is provided which includes a first end and a second end and which extends through the aperture in the removable cap means, with the first end thereof disposed within the longitudinal passageway and with the second end thereof disposed outside the longitudinal passageway. The removable cap means carries seal means for providing slidingly and rotatingly sealing engagement between the aperture in the cap means and the operating shaft so that the operating shaft may be moved axially and rotatably within the longitudinal passageway. The first end of the operating shaft is secured to engaging means for releasably engaging the threaded closure member in the access fitting. Control means operatively engages the second end of the operating shaft for rotating and axially displacing the engaging means within the longitudinal passageway in response to stimulus external thereto. Valve means is carried by the body member intermediate the first and second ends thereof for alternately opening and closing the longitudinal passageway, the valve means being adapted to close the longitudinal passageway when the operating shaft is displaced toward the second end of the body member. Actuating means operatively engages the valve means for moving the valve means between a position opening and a position closing the longitudinal passageway in response to stimulus external thereto.

An object of the present invention is to provide an efficient tool for maintaining and servicing a pressurized refrigeration system or the like.

Another object of the present invention is to provide an improved method and tool for maintaining and servicing a pressurized refrigeration system which allows the removal and replacement of a defective access valve core in a pressurized refrigeration system without requiring depressurization of the system.

A further object of the present invention is to provide an improved method and apparatus for maintaining and servicing a pressurized refrigeration system which permits the removal and replacement of a defective access valve core in a refrigeration system and further permits the evacuation and/or recharging of the system by means of the same tool.

A still further object of the present invention is to provide a tool for maintaining and servicing a pressurized refrigeration system or the like which is economical to manufacture and simple to operate.

Other objects and advantages of the present invention will be evident from the following detailed description when read in conjunction with the accompanying drawings.

DESCRIPTION OF THE PREFERRED EMBODIMENT

Figure 1:
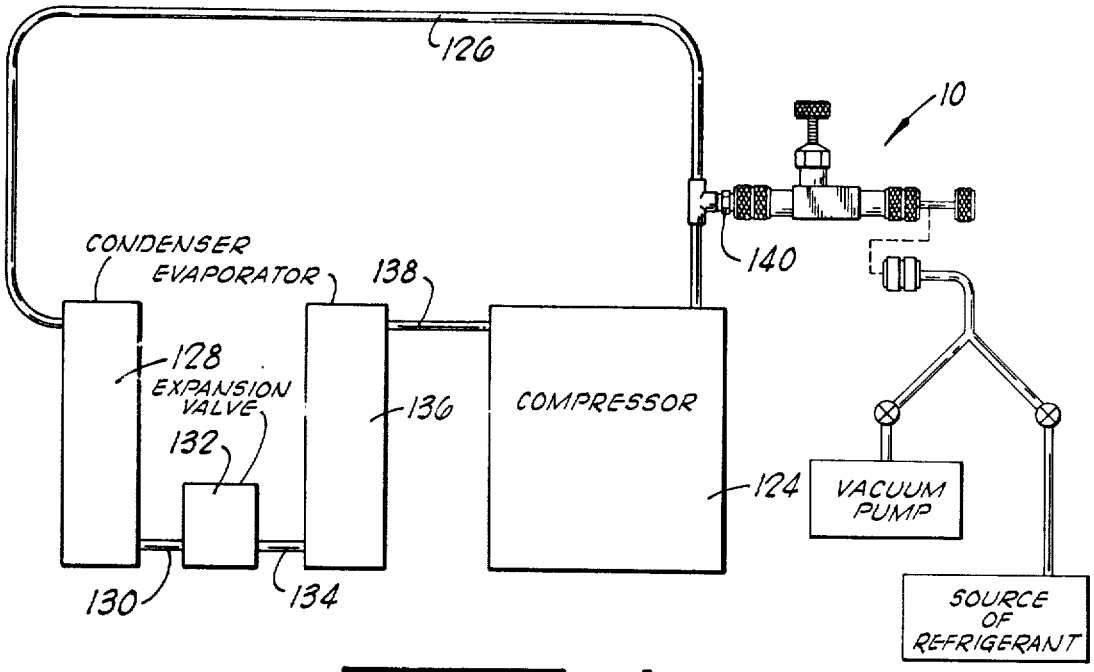
FIG. 1 is a schematic diagram of a refrigeration system with the tool of the present invention connected to the high pressure side of the compressor.

Referring now to the drawings and to FIGS. 1–5 in particular, the apparatus of the present invention is generally designated by the reference character 10.

The apparatus 10 is a tool which includes a body member 12 having a first end portion 14 and a second end portion 16. A cylindrical bore 18 extends through the body member 12 communicating with the first and second end portions 14 and 16 thereof forming a longitudinal passageway through the body member 12. The outer periphery 20 of the body member 12 adjacent to the first end portion 14 is cylindrically shaped. A circumferential groove 22 is formed in the outer periphery 20 and includes first and second cylindrical surfaces 24 and 26 interconnected by an inclined surface 28. The diameter of the second cylindrical surface 26 is greater than the diameter of the first cylindrical surface 24.

A coupling nut 30 is rotatably secured to the first end portion 14 and body member 12. The coupling nut 30 includes a cylindrically shaped inner peripheral portion 32 slidingly disposed around the outer periphery 20 of the body member 12. The coupling nut 30 is retained on the body member 12 by means of a snap ring 34 carried in an annular groove 36 formed in the inner peripheral portion 32 and engaging the circumferential groove 22 in the body member 12.

Internal threads 38 are formed in the outer end portion 40 of the coupling nut 30. A suitable annular Neoprene gasket 42 is positioned within the coupling nut 30 between the threads 38 thereof and the first end portion 14 of the body member 12.

External threads 44 are formed on the outer periphery of the body member 12 adjacent to the second end portion 16 thereof. An access cap 46 is threadedly secured to the second end portion 16 of the body member 12 by means of internal threads 48 formed therein and threadedly engaging the external threads 44 of the body member 12. The access cap 46 includes a bore 50 formed therein coaxial with the axis of the bore 18 formed in the body member 12. A first counterbore 52 is formed in the access cap 46 coaxial with the bore 50. A second counterbore 54 is formed in the access cap 46 coaxial with the first counterbore 52 in the bore 50. An annular retainer 56 having a cylindrically shaped outer periphery 58 having a diameter slightly less than the diameter of the second counterbore 54 is positioned within the second counterbore 54 intermediate the internal threads 48 and the first counterbore 52 formed therein.

An operating shaft 60 having a cylindrically shaped outer periphery extends through the bore 50 in the access cap 46 and through the annular retainer 56. The first end portion 62 of the oprating shaft 60 is disposed within the bore 18 of the body member 12. A control knob 64 is rigidly secured to the second end portion 66 of the operating shaft 60 by means of a set screw 68 threadedly secured in the control knob 64 and bearing against the second end portion 66 of the operating shaft 60.

A pair of O-rings 70 are positioned within the first counterbore 52 of the access cap 46 and provide a fluid-tight seal between the access cap 46 and the operating shaft 60. The fluid-tight seal obtained by the O-rings 70 permits the operating shaft to be axially and rotatably displaced relative to the access cap 46 without fluid leakage thereby. The O-rings 70 are retained in proper position within the first counterbore 52 by the annular retainer 56. A fluid-tight seal is obtained between the acccess cap 46 and the second end portion 16 of the body member 12 by means of an O-ring 72 positioned therebetween.

The threads 44 on the body member 12 and the threads 48 on the access cap 46 are suitably formed such that when the cap 46 is removed from the body member 12 suitable means for evacuating and charging (not shown) a refrigeration system, such as a vacuum pump and a source of refrigerant as shown in FIG. 1, may be threadedly engaged to the threads 44 to provide sealing engagement between said means and the body member 12 so that a refrigeration system may be evacuated and charged with refrigerant through the cylindrical bore 18 through the body member 12. A suitable, and industry-accepted thread for this purpose is 7/16–20 N.F. thread.

Figure 5:
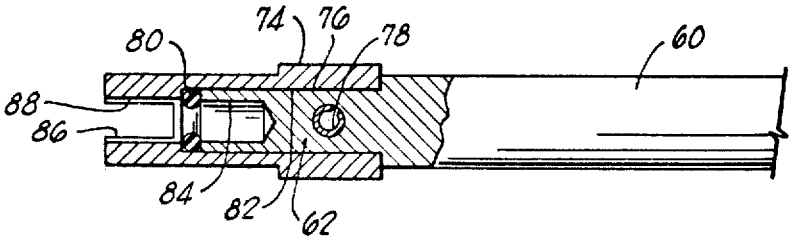
FIG. 5 is an enlarged partial cross-sectional view illustrating the construction details of the valve core engaging chuck on the operating shaft.

As most clearly shown in FIG. 5, a suitable valve core engaging chuck 74 is secured to a reduced portion 76 of the operating shaft 60 by a roll pin 78. An O-ring 80 is secured within a counterbore 82 formed in the chuch 74 near thebifurcated end thereof and is retained in proper position by the reduced portion 76 of the operating shaft 60 adjacent thereto. An axial bore 84 is formed in the first end portion 62 of the operating shaft 60 for receivint the outwardly extending head of the valve core being engaged by the chuck 74. A transverse slot 86 is formed in the chuck 74 for receiving the rectangular portion of the valve core therein for threading and unthreading the valve core in its fitting. A bore 88 is also formed in the chuck 74 coaxial with the counterbore 82 for receiving the head of the valve core therethrough. The inner diameter of the resilient O-ring 80 is sized such that a valve core engaged by the chuck 74 will be releasably retained thereby by means of the engagement of the head of the valve core by the O-ring 80.

A shut-off valve assembly 90 is carried by the body member 12. The shut-off valve assembly 90 includes a valve fitting 92 suitably formed on the body member 12 and extending outwardly therefrom. A lateral bore 94 extends through the valve fitting 92 and partially through the body member 12 intersecting the cylindrical bore 18 through the body member 12. The axis of the lateral bore 94 intersects the axis of the cylidrical bore 18 and is normal thereto. The diameter of the lateral bore 94 is greater than the diameter of the cylindrical bore 18. The lower end of the bore 94 extends completely through the cylindrical bore 18 and terminates in a flat circular wall 96 formed in the body member 12.

A valve stem 98 is positioned within the lateral bore 94. A control knob 100 is fixedly secured to the upper end 102 of the valve stem 98 by means of a set screw 104.

A cylindrically shaped resilient valve member 106 is fixedly secured to the lower end 108 of the valve stem 98. The valve member 106 is preferably formed of a short length of resilient tubing formed of a suitable material such as Neoprene. The outer diameter of the valve member 106 is substantially equal to the diameter of the lateral bore 94 and the axial length of the valve member 106 is greater than the diameter of the cylindrical bore 18 extending rhrough the body member 12. The valve member 106 may be secured by a suitable adhesive to the cylindrical outer periphery of the lower end 108 of the valve stem 98.

A pair of spaced circumferential ribs 110 and 112 are formed on the valve stem 98 with the rib 110 abutting the upper end of the resilient valve member 106. An O-ring 114 is positioned between the circumferential ribs 110 and 112 and provides a fluid-tight seal between the valve stem 98 and the lateral bore 94. External threads 116 are formed on the valve stem 98 and extend between the control knob 100 and the circumferential rib 112.

The valve stem 98 is secured within the valve fitting 92 by means of a valve fitting cap 118 threadedly secured to the valve fitting 92. The external threads 116 of the valve stem 98 are threadedly engaged with internal threads 120 formed in an aperture 122 in the valve fitting cap 118 through which the valve stem 98 extends.

Figure 2:
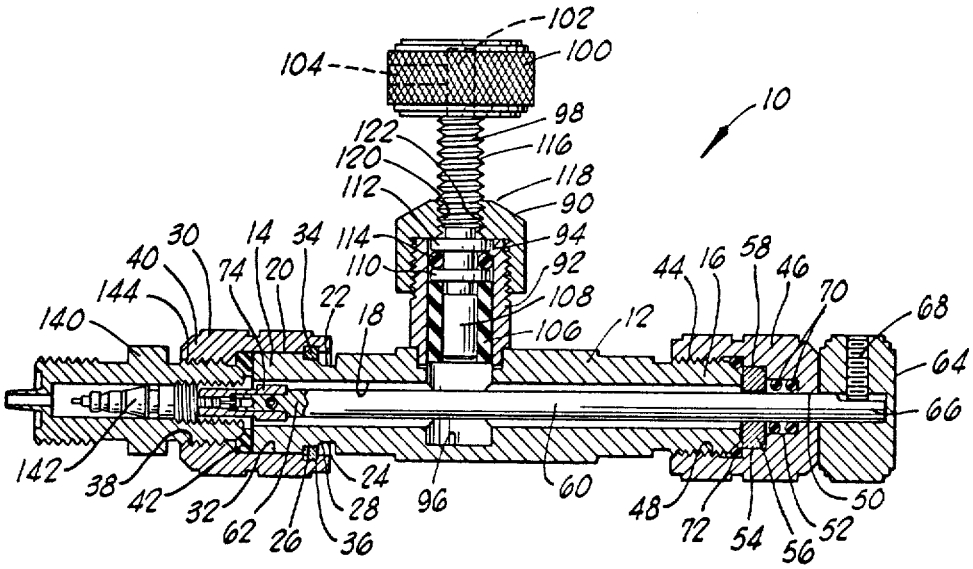
FIG. 2 is a cross-sectional view of one embodiment of the present invention illustrating the engaging means in engagement with the threaded check valve of the refrigeration system and with the valve means opening the passageway of the tool.
Figure 3:
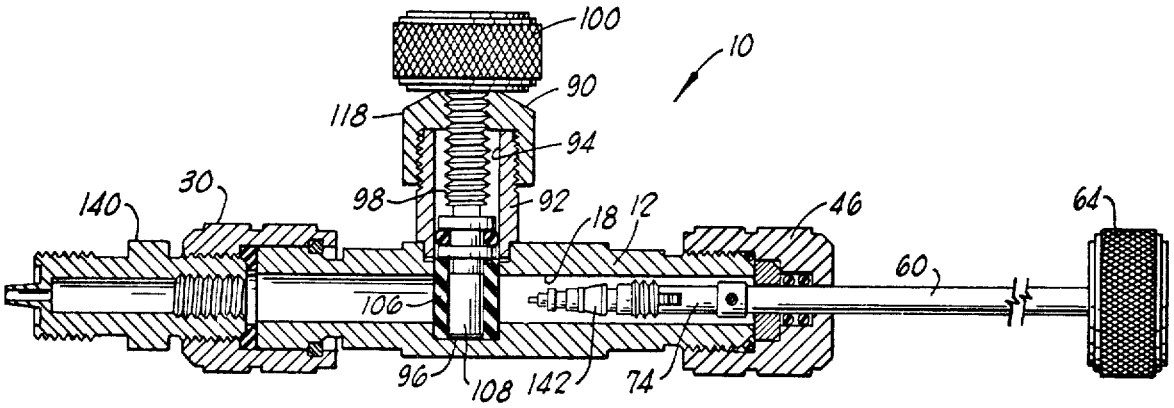
FIG. 3 is a cross-sectional view similar to FIG. 2 illustrating the threaded check valve fully withdrawn from the refrigeration system into the passageway of the tool and with the valve means closing the passageway.

It will be seen that by rotating the control knob 100 the valve stem 98 will move axially within the lateral bore 94 as the valve stem 98 is alternately threaded and unthreaded in the valve fitting cap 118. FIG. 2 illustrates the shut-off assembly 90 in the open position with the resilient valve member 106 fully retracted within the lateral bore 94. FIG. 3 illustrates the shut-off valve assembly 90 in the closed position with the resilient valve member 106 closing the cylindrical bore 18 through the body member 12. It will be seen that the resilient valve member 106 extends slightly below the lower end 108 of the valve stem 98. This permits the valve stem 98 to be threaded to a point wherein the lower end 108 thereof engages the flat circular wall 96 in the body member 12. In this position the resilient valve member 106 is axially compressed and forms a fluid-tight seal closing the cylindrical bore 18 in the body member 12.

It should be noted at this point that the valve fitting 92 may be in the form of a separate component suitably secured to the body member 12 by means such as soldering or brazing, or the valve fitting 92 and the body member 12 may be integrally formed in one piece.

FIG. 1 schematically illustrates a conventional refrigeration system to which the apparatus 10 is connected. The refrigeration system includes a compressor 124 having its high pressure side connected by means of conduit 126 to the inlet of a condensor 128. The outlet of the condensor 128 is connected by conduit 130 to an expansion valve 132. The expansion valve 132 is connected by means of conduit 134 to the inlet of an evaporator 136. The outlet of the evaporator 136 is connected by conduit 138 to the low pressure side of the compressor 124 thereby completing the refrigeration loop.

An access fitting 140 is shown connected to the conduit 126 adjacent to the high pressure side of the compressor 124. The access fitting 140 is of the type which includes a threaded check valve core 142 installed therein. The valve core 142 is of the type which is typically referred to as Schrader-type valve core. Such valve cores are commonly used in automotive tires and the like.

Figure 4:
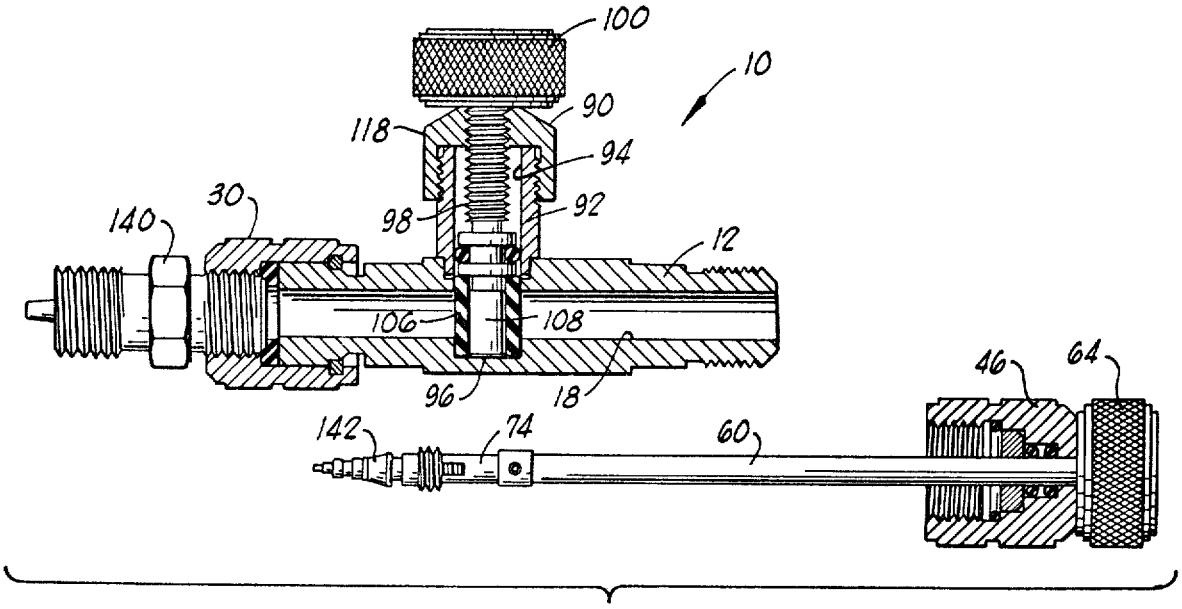
FIG. 4 is a cross-sectional view similar to FIG. 3 illustrating the threaded check valve removed from the tool for inspection and replacement.

FIGS. 2–4 illustrate the tool 10 installed on the access fitting 140 with the coupling nut 30 threadedly secured to the external threads 144 of the access fitting 140 and with the gasket 42 providing a fluid-tight seal btween the outer end of the access fitting 140 and the first end portion 14 of the body member 12 of the tool 10. The valve 142 is shown properly secured by the valve core engaging chuck 74.

Operation of the Preferred Embodiment

To operate the tool 10, the tool 10 is connected to a suitable access fitting 140 by means of the coupling nut 30 as shown in FIGS. 1 and 2. The shut-off valve assembly 90 is placed in the open position as illustrated in FIG. 2 and the operating shaft 60 is moved to the left as viewed in FIG. 2 where the core engaging chuck 74 is suitably engaged with the valve core 142 which is to be removed from the access fitting 140.

The valve core 142 is then unthreaded by turning the control knob 64 counterclockwise. When the valve core 142 is completely unthreaded from the access fitting 140 to the control knob 64 is withdrawn as far to the right as possible as illustrated in FIG. 3. The shut-off valve assembly is then actuated to close the cylindrical bore 18 through the body member 12. This is accomplished by rotating the control knob 100 in a clockwise direction until the lower end of the valve stem 108 seats on the flat circular wall 96 in the valve body 12 thereby providing a fluid-tight seal in the tool 10.

The access cap 46 is then unthreaded from the body member 12, and the access cap 46, operating shaft 60 and the valve core 142 are removed from the body member 12.

At this point suitable means for evacuating and charging a refrigeration system, as shown in FIG. 1, is threadedly securd to the threads 44 of the body member 12 to provide sealing communication between said means and the access fitting 140 via the cylindrical bore 18 through the body member 12. The shutoff valve assembly is then actuated to open the bore 18 through the body member 12. The refrigeration system carrying the access fitting 140 may then be evacuated and charged with refrigerant through the tool 10. When the refrigeration system is charged, the shut-off valve assembly is again actuated to close the bore 18 as described above, and the evacuating and charging means is removed from the tool 10.

The valve core 142 may then be inspected and replaced if necessary. The new valve core 142 is secured to the valve core engaging chuch 74 and reinserted into the cylindrical bore 18 along with the operating shaft 60. The access cap 46 is rethreaded into sealing engagement with the body member 12.

The shut-off valve assembly 90 is then opened fully by rotating the control knob 100 in a counterclockwise direction until the resilient valve member 106 is fully withdrawn into the lateral bore 94 thereby opening the cylindrical bore 18.

The control knob 64 is then moved to the left until the check valve core 142 engages the access fitting 140. The check valve core 142 is then rethreaded into the access fitting 140 by rotating the control knob 64 in a clockwise direction until the check valve core sealingly engages the access fitting 140. At this time the tool 10 may be removed from the access fitting 140 by unthreading the coupling nut 30.

Figure 6:
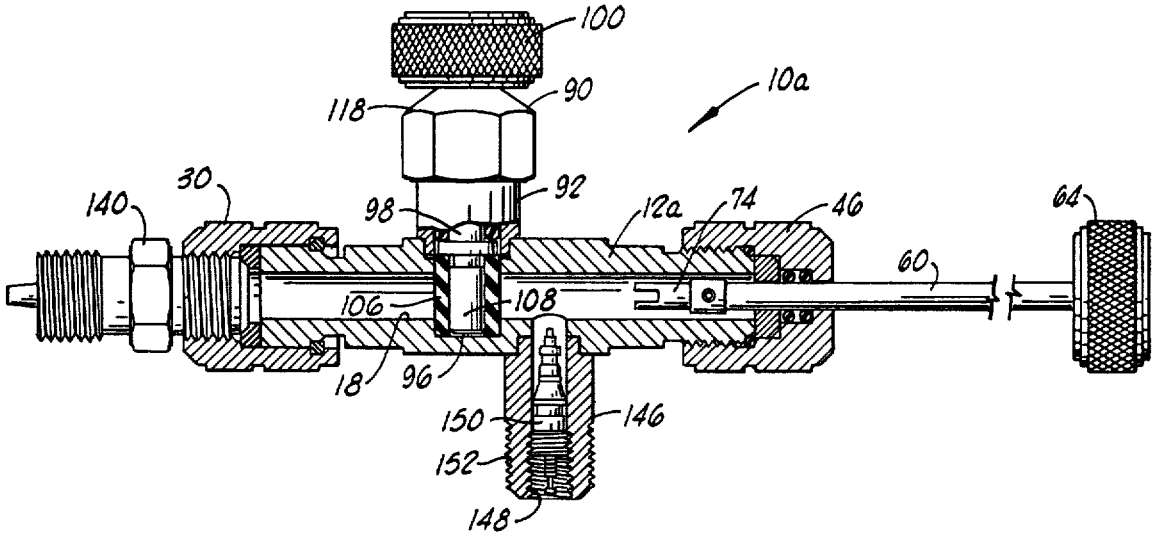
FIG. 6 is a cross-sectional view of an alternate embodiment of the present invention.

Description of the Embodiment of FIG. 6

FIG. 6 illustrates a slightly modified tool 10*a* which includes an evacuating and charging fitting 146 formed on and extending outwardly from a slightly modified body member 12*a*. The fitting 146 includes a laterally extending port 148 extending therethrough and communicating between the outer end thereof and the cylindrical bore 18 through the body member 12*a*. A conventional threaded check valve core of the schrader-type 150 is threadedly secured within the fitting 146. The fitting 146 further includes external threads 152 formed thereon to provide means for engagement with suitable means for evacuating and charging a refrigeration system, as shown in FIG. 1, through the tool 10*a*.

Operation of the Embodiment of FIG. 6

In operation the tool 10*a* is first secured to the access fitting 140 as described above. Similarly, the check valve core 142 is removed from the access fitting 140 and withdrawn fully to the right within the bore 18 as viewed in FIG. 6. With the shut-off valve assembly 90 in the open position, the refrigeration system may now be evacuated and charged through the evacuation and charging fitting 146.

It will be readily apparent that the tool 10*a* may also be used to remove and replace a defective check valve core 142 as described in detail above for the tool 10. This should preferably be done prior to evacuating and charging the refrigeration system.

Figure 7:
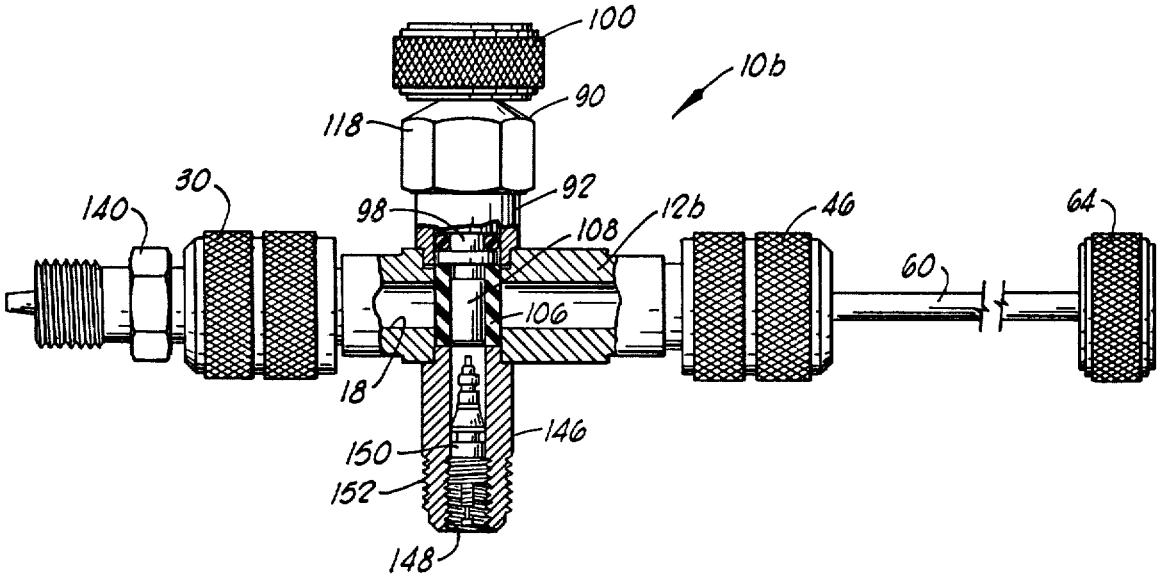
FIG. 7 is a cross-sectional view of another form of the presnt invention.

Description of the Embodiment of FIG. 7

FIG. 7 illustrates another slightly modified tool 10*b*, similar to the tool 10*a* described above. The tool 10*b* differs from the tool 10*a* in that the evacuation and charging fitting 146 is formed on the slightly modified body member 12*b* in coaxial alignment with the lateral bore 94 of the shut-off valve assembly 90. It will be seen that the port 148 of the evacuation and charging fitting 146 communicates with the interior of the body member 12*b* through the flat circular wall 96 formed therein.

The configuration of the tool 10*b* permits a slightly shorter body member 12*b*, and simplifies machining required in the construction of the tool 10*b*.

Operation of the tool 10*b* is identical to that described for the tool 10*a* and therefore will not be described in detail again.

Figure 8:
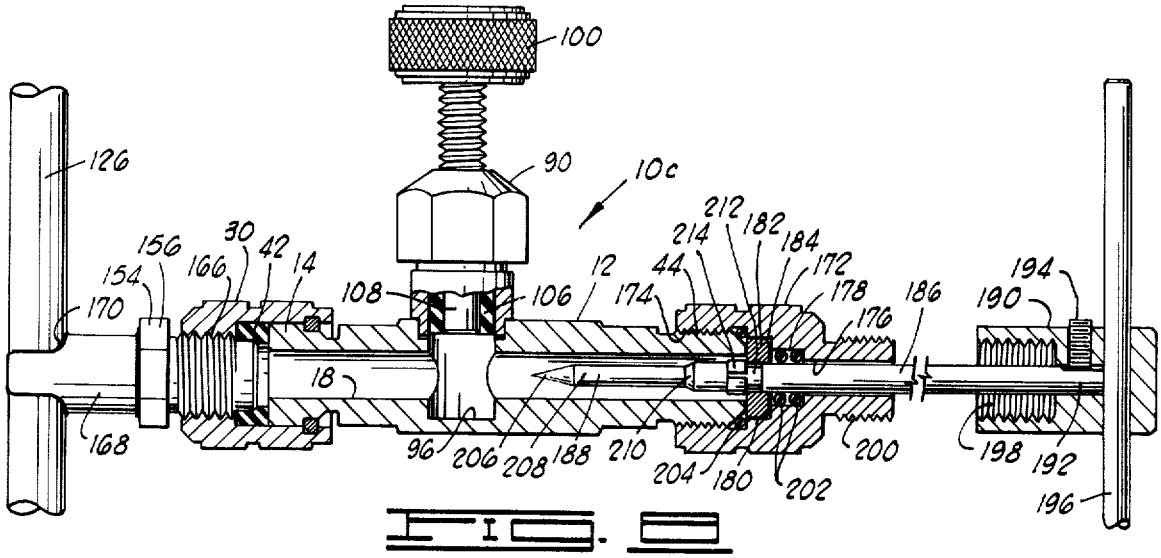
FIG. 8 is a vertical partial cross-sectional view of an alternate embodiment of the present invention illustrating the tool connected to a slightly modified access fitting secured to the conduit of a sealed refrigeration system with the valve means opening the passageway of the tool prior to penetration of the conduit.
Figure 9:
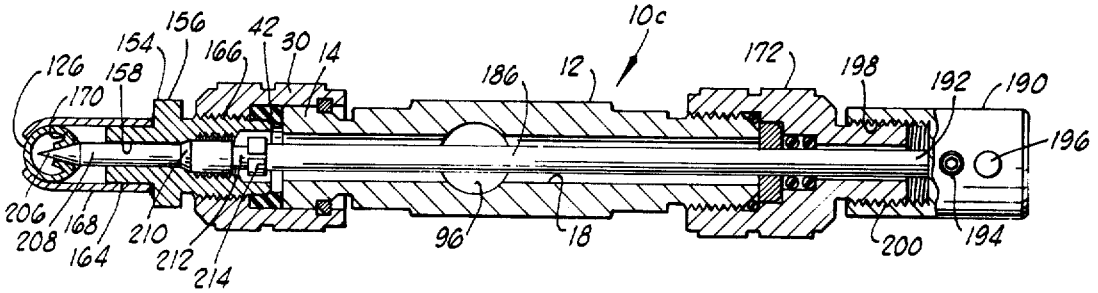
FIG. 9 is a horizontal cross-sectional view of the apparatus of FIG. 8 illustrating the tool connected to the access fitting after penetration of the conduit by conduit penetrating means.
Figure 10:
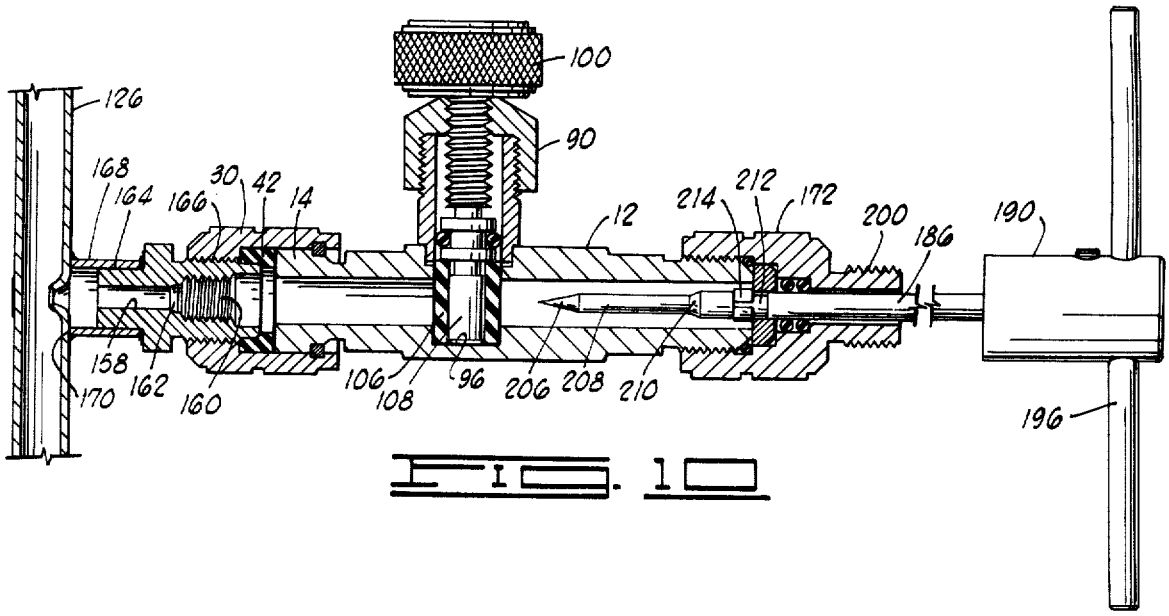
FIG. 10 is a vertical cross-sectional view of the apparatus of FIG. 8 illustrating the tool connected to the access fitting with the conduit penetrating means withdrawn from the conduit and with the valve means closing the passageway of the tool.

Description of the Embodiment of FIGS. 8–10

In certain cases it is desirable to provide completely sealed pressurized refrigeration systems which require the initial penetration or invasion of the system and the installation of a suitable threaded check valve core at the time of servicing. When it becomes necessary to open and service such refrigeration systems, a line tap access fitting 154 is first installed on the conduit 126 connected to the compressor 124 of the refrigeration system illustrated in FIG. 1. The access fitting 154 includes a threaded body portion 156 having a longitudinal passageway 158 extending therethrough. The passageway 158 is internally threaded to receive a threaded check valve core 142 therein. Intermediate the internal threads 160 and the conduit 126, a substantially conically shaped shoulder or seat 162 is formed within the passageway 158 against which the valve core 142 is firmly seated when installed within the fitting 154.

The body portion 156 of the access fitting 154 is preferably formed of brass and includes a cylindrically shaped outer portion 164 formed on one end opposite external threads 166 formed on the other end. A short length of copper tubing 168 is soldered or brazed at one end thereof to the cylindrically shaped outer surface 164. The opposite end of the coppr tubing 168 has a transverse arcuately shaped groove 170 formed therein sized and shaped to receive the outer periphery of the conduit 126 thereagainst. The copper tubing 168 is then soldered to the conduit 126 along the line of intersection therebetween to provide a complete fluid-tight seal between the interior of the line tap access fitting 154 and the as yet unpenetrated outer periphery of the conduit 126. Other forms of access fittings which are clamp or otherwise secured to the conduit 126 may also be employed.

FIGS. 8–10 illustrate a slightly modified tool 10*c* which provides means for providing initial penetration and access to the conduit 126 of the refrigeration system for servicing the system. The apparatus 10*c* comprises the previously described body member 12 and shut-off valve assembly 90 carried therein. The apparatus 10*c* differs from the previously described apparatus 10 in the utilization of the modified access cap 172 which is secured to the second end portion 16 of the body member 12 by means of internal threads 174 formed therein threadedly engaging the external threads 44 of the body member 12. The access cap 172 includes a bore 176 formed therein coaxial with the axis of the bore 18 formed in the body member 12. A first counterbore 178 is formed in the access cap 172 coaxial with the bore 176. A second counterbore 180 is formed in the access cap 172 coaxial with the first counterbore 178 and the bore 176. An annular retainer 182 having a cylindrically shaped outer periphery 184 with a diameter slightly less than the diameter of the second counterbore 180 is positioned within the second counterbore 180 intermediate the internal threads 174 and the first counterbore 178 formed therein.

An operating shaft 186, preferably formed of steel drill rod or the like and having a substantially cylindrically shaped outer periphery, extends through the bore 176 in the access cap 172 and through the annular retainer 182. The first end portion 188 of the operating shaft 186 is disposed within the bore 18 of the body member 12. A control handle 190 is rigidly secured to the second end portion 192 of the operating shaft 186 by means of a set screw 194 threadedly secured in the control handle 190 and bearing against the second end portion 192 of the operating shaft 186. The control handle 190 further includes a transverse bar 196 extending therethrough normal to the axis of the operating shaft 186 and rigidly secured thereto by suitable means.

The control handle 190 further includes an internally threaded portion 198 formed therein. The internally threaded portion 198 is threadedly engageable with an externally threaded portion 200 formed on the end of the access cap 172 adjacent the control handle 190.

A pair of O-rings 202 are positioned within the first counterbore 178 of the access cap 172 and provide a fluid-tight seal between the access cap 172 and the operating shaft 186. The fluid-tight seal obtained by the O-rings 202 permits the operating shaft to be axially and rotatably displaced relative to the access cap 172 without fluid leakage thereby. The O-rings 202 are retained in proper position within the first counterbore 178 by the annular retainer 182. A fluid-tight seal is obtained between the access cap 172 and the second end portion 16 of the body member 12 by means of an O-ring 204 positioned therebetween.

The thread 44 on the body member 12 and the threads 174 on the access cap 172 are suitably formed such that when the cap 172 is removed from the body member 12 suitable means for evacuating and charging a refrigeration system, as shown in FIG. 1, may be threadedly engaged to the threads 44 to provide sealing engagement between said means and the body member 12 so that a refrigeration system may be evacuated and charged with refrigerant through the cylindrical bore 18 formed in the body member 12. A suitable, and industry accepted thread for this purpose is 7/16–20 N.F. thread.

A substantially conically shaped point 206 is formed on the end of the first end portion 188 of the operating shaft 186. A cylindrically shaped outer periphery 208 is formed on the first end portion 188 and communicates with the conically shaped point 206. A frusto-conically shaped shoulder 210 is formed on the first end portion 188 of the operating shaft 186 and communicates between the cylindrically shaped periphery 208 and the substantially cylindrically shaped outer priphery of the remainder periphery the operating shaft 186. It will be seen that the cylindrically shaped outer periphery 208 is of a diameter slightly less than the diameter of the outer periphery of the remainder of the operating shaft 186. An annular groove 212 is formed in the outer periphery of the operating shaft 186 adjacent to the shoulder 210. An annular retainer ring 214 is disposed within the annular groove 212 and has an outer diameter greater than the inner diameter of the annular retainer 182. The annular retainer 214 may be suitably formed of a metallic split ring. It will be seen that the annular retainer 214 is sized and shaped to prevent the withdrawal of the operating shaft 186 from the access cap 172.

It should also be understood that the longitudinal distance between the conically shaped point 206 and the frusto-conically shaped shoulder 210 formed on the first end portion 188 of the operating shaft 186 is selected so that the point 206 will fully penetrate one side of the conduit 126 when the shoulder 210 is seated against the previously mentioned shoulder 162 in the line tap access fitting 154 as will be discussed more fully hereinafter.

Operation of the Apparatus of FIGS. 8–10

To operate the tool 10*c*, the body member 12 of the tool 10*c* is connected to the access fitting 156 by means of the coupling nut 30 threadedly secured to the external threads 166 of the line tap access fitting 154 with the gasket 42 providing a fluid-tight seal between the outer end of the access fitting 154 and the first end portion 14 of the body member 12, as shown in FIG. 8. It will be noted that no valve core is installed within the access fitting 154 at this time.

The shut-off valve assembly 90 is placed in the open position as illustrated in FIG. 8. The access cap 172, with the operating shaft 186 slidably installed therein as described above, is then threadedly secured to the external threads 44 of the body member 12 by means of the internal threads 174 formed therein. A fluid-tight seal is achieved between the body member 12 and the access cap 172 by means of the O-ring seal 204 as also shown in FIG. 8.

The control handle 190 is then moved longitudinally toward the body member 12 until the internal threads 198 of the control handle 190 abut the general threaded portion 200 of the access cap 172. The control handle 190 is then rotated in a clockwise direction to threadedly engage the internally threaded portion 198 of the control handle 190 with the externally threaded portion 200 of the access cap 172 thereby driving the operating shaft 186 from right to left within the bore 18 through the body member 12. Continued rotation of the control handle 190 relative to the access cap 172 will cause the conically shaped point 206 of the operating shaft 186 to initially engage the outer periphery of the conduit 126 within the line tap access fitting 154 and ultimately penetrate the conduit 126 as shown in FIG. 9.

When the frusto-conically shaped shoulder 210 of the operating shaft 186 engages the shoulder 162 within the threaded body portion 156 of the access fitting 154, no further penetration of the conduit 126 by the conically shaped point 206 is permitted. Further, the rotary engagement of the shoulder 162 of the access fitting 154 by the shoulder 210 of the operating shaft 186 provides a burnishing action on the shoulder 162 to enhance the sealing capability of the shoulder or seat 162 when the valve core 142 is inserted therein as will be described hereinafter.

The control handle 190 is then rotated in the opposite, counterclockwise direction to threadedly disengage the internally threaded portion 198 of the operating handle 190 from the externally threaded portion 200 of the access cap 172. This unthreading action withdraws the conically shaped point 206 of the operating shaft 186 from the conduit 126 thereby opening the conduit 126 to the interior of the access fitting and the interior of the tool 10*c*. Continued counterclockwise rotation of the control handle 190 causes threaded disengagement between the control handle 190 and the access cap 172 thus permitting the withdrawal of the operating shaft 186 from left to right throught the bore 18 of the body member 12. This movement of the operating shaft 186 may be achieved by manually pulling the operating handle 190, however, the pressure within the pressurized refrigeration system acting on the interior of the tool 10*c* will, in most cases, force the operating shaft 186 from left to right within the tool 10*c* until the annular retainer 214 carried on the operating shaft 186 engages the annular retainer 182 carried within the access cap 172.

The shut-off valve assembly 90 is then actuated to close the cylindrical bore 18 through the body member 12. As described above, this is accomplished by rotating the control knob 100 in a clockwise direction until the lower end of the valve stem 108 seats on the flat circular wall 96 in the valve body 12 thereby providing a fluid-tight seal in the bore 18 of the valve body 12 of the tool 10*c*.

The access cap 172 is then unthreaded from the body member 12, and the access cap 172 and operating shaft 186 are removed from the body member 12.

At this point suitable means for evacuating and charging a refrigeration system, as shown in FIG. 1, is threadedly secured to the threads 44 of the body member 12 to provide sealing communication between said means the the access fitting 154 via the cylindrical bore 18 through the body member 12. The shut-off valve assembly 90 is then actuated to open the bore 18 to the body member 12. The refrigeration system carrying the access fitting 154 will then be evacuated and charged with refrigerant through the tool 10*c*. When the refrigeration system is charged, the shut-off valve assembly is again actuated to close the bore 18 as described above, and the evacuating and charging means is removed from the tool 10*c*.

A new valve core 142 is then secured to the valve core engaging chuck 74 of the previously described operating shaft 60 and inserted into the cylindrical bore 18 along with the operating shaft 60. The previously described access cap 46 is threaded into sealing engagement with the body member 12 as also previously described.

The shut-off valve assembly 90 is then opened fully by rotating the control knob 100 in a counterclockwise direction until the resilient valve member 106 is fully withdrawn into the lateral bore 94 thereby opening the cylindrical bore 18 through the body member 12.

The control knob 64 is then moved to the left until the check valve core 142 engages the access fitting 154. The check valve core 142 is then threaded into the internal threads 160 of the access fitting 154 by rotating the control knob 64 in a clockwise direction until the check valve core sealingly engages the conically shaped annular shoulder or seat 162 of the access fitting 154. At this time the tool 10*c* may be removed from the line tap access fitting 154 by unthreading the coupling nut 30 therefrom.

It should be clearly understood that the previously described slightly modified tools 10*a* and 10*b* may also be employed in the servicing of pressurized refrigeration systems through the previously described line tap access fitting 154 installed therein. The access cap 172, operating shaft 186 and control handle 190, the structure and operation which has been described in detail above, may be employed with the modified tools 10*a* and 10*b* to provide initial access to the previously completely sealed, pressurized refrigeration system requiring service. The operation of the access cap 172, operating shaft 186 and control handle 190 in conjunction with the modified tools 10*a* and 10*b* will be readily apparent to those skilled in the art and need not be described in detail at this point.

It will be seen from the foregoing detailed description of the present invention that the various embodiments thereof and the methods for their utilization described therein readily obtain the objectives set forth. Changes may be made in the construction and arrangement of parts or elements of the various embodiments described herein without departing from the spirit and scope of the present invention as defined herein.

What is claimed is:

1. A tool for use in maintaining and servicing a conventional sealed refrigeration system equipped with an internally and externally threaded access fitting adapted to receive a removable threaded closure member therein and secured in communication with and in substantially normal alignment with a penetrable wall of the sealed refrigeration system, comprising:

a body member having a first end, a second end and having a longitudinal passageway extending therethrough communicating at the opposite ends thereof with the first and second ends of the body member;

coupling means carried on the first end of said body member for removably connecting the first end of said body member to said access fitting with one end of said longitudinal passageway in sealing communication with the access fitting;

first removable cap means securable to the second end of said body member for sealing closure of the opposite end of said longitudinal passageway and, alternately, for removal from said body member, and including an aperture formed therein substantially coaxial with the longitudinal passageway;

an externally threaded surface formed on said first removable cap means remote from the second end of said body member and coaxial with the aperture formed therein;

a first operating shaft having a first end and a second end and extending through said aperture in said first removable cap means, with the first end thereof disposed within said longitudinal passageway and with the second end thereof disposed outside said longitudinal passageway;

means carried by said first removable cap means for providing sliding and rotatingly sealing engagement between said aperture in said first cap means and said first operating shaft so that said first operating shaft may be moved axially and rotatably within said longitudinal passageway;

a substantially conical point formed on the first end of said first operating shaft for penetrating the penetrable wall of said sealed refrigeration system to open the interior of said sealed refrigeration system to the interior of said access fitting;

control means operatively engaging the second end of said first operating shaft for threadedly engaging the external threads of said first removable cap means and for rotating and axially displacing said substantially conical point within said longitudinal passageway and the interior of said access fitting in response to stimulus external thereto;

second removable cap means securable to the second end of said body member in alteration with said first removable cap means for sealing closure of the opposite end of said longitudinal passageway and, alternately, for removal from said body member, and including an aperture formed therein substantially coaxial with the longitudinal passageway;

a second operating shaft having a first end and a second end and extending through said aperture in said second removable cap means, with the first end thereof disposed within said longitudinal passageway and with the second end thereof disposed outside said longitudinal passageway;

means carried by said second removable cap means for providing slidingly and rotatingly sealing engagement between said aperture in said second cap means and said second operating shaft so that said second operating shaft may be moved axially and rotably within said longitudinal passageway;

engaging means secured to the first end of said second operating shaft for releasably engaging and retaining said threaded closure member therein for installation and removal of said threaded closure member in and from said access fitting;

control means operatively engaging the second end of said second operating shaft for rotating and axially displacing said engaging means within said longitudinal passageway in response to stimulus external thereto;

valve means carried by said body member intermediate the first and second ends thereof for alternately opening and closing said longitudinal passageway, said valve means being adapted to close said longitudinal passageway when said operating shafts are displaced toward the second end of said body member; and actuating means operatively engaging said valve means for moving said valve means between a position opening and closing said longitudinal passageway in response to stimulus external thereto.

2. The tool as defined in claim 1 wherein said valve means is characterized further to include:

a valve fitting formed on said body member and extending laterally therefrom;

a lateral bore extending through said valve fitting and a portion of said body member and communicating between said longitudinal passageway and the outer end of said valve fitting; and resilient valve member means slidably disposed within said lateral bore for moving between a position within said lateral bore and opening said longitudinal passageway and a position within and closing said longitudinal passageway.

3. The tool as defined in claim 2 wherein:

said valve means is characterized further to include a valve stem partially disposed within said lateral bore and fixedly secured at one end thereof to said valve member means and having the opposite end thereof extending outside the valve fitting; and wherein said actuating means is characterized further as operatively engaging the opposite end of said valve stem for moving said valve stem and said valve member means axially within said lateral bore and normal to the axis of said longitudinal passageway thereby moving said valve member means between a position within said lateral bore and opening said longitudinal passageway and a position within and closing said longitudinal passageway in response to stimulus external thereto.

4. The tool as defined in claim 3 wherein:

said valve stem is characterized further to include external threads formed thereon adjacent to the opposite end thereof; and said tool is characterized further to include means threadedly secured to the threaded portion of said valve for securing said valve stem to said valve fitting so that rotation of said valve stem relative to said means and said valve fitting by said actuating means causes a corresponding movement of said valve stem and said valve member means axially within said lateral bore and normal to the axis of said longitudinal passageway thereby moving said valve member means between a position within said lateral bore and opening said longitudinal passageway and a position within and closing said longitudinal passageway in response to stimulus external to said actuating means.

5. The tool as defined in claim 4 characterized further to include:

annular seal means disposed around said valve stem for providing sealing engagement between said valve stem and said lateral bore.

6. The tool as defined in claim 1 characterized further to include:

a laterally extending port formed in said body member intermediate said valve means and the second end of said body member and communicating between said longitudinal passageway and the exterior of said body member.

7. The tool as defined in claim 6 characterized further to include:

a Schrader-type valve core removably threadedly secured within said laterally extending port.

8. The tool as defined in claim 1 characterized further to include:

a laterally extending port formed in said body member intermediate the first and second ends thereof disposed opposite said valve fitting and aligned coaxial with said lateral bore extending through said valve fitting and communicating between said longitudinal passageway and the exterior of said body member.

9. The tool as defined in claim 8 characterized further to include:

a Schrader-type valve core removably threadedly secured within said laterally extending port.

10. A method of servicing the compressor of a sealed refrigeration system through a threaded access fitting adapted to receive a removable threaded closure member therein and secured in communication with a penetrable wall of the sealed refrigeration system, comprising the steps of:

sealingly engaging said access fitting with the first end of a tool having a sealed passageway formed therein and communication with the first end of said tool and having a removable end cap sealingly engaging the opposite end of said passageway, said tool having valve means disposed in said passageway intermediate the first end of said tool and the opposite end of said passageway and movable between a position opening said passageway and a position closing said passageway, and having evacuating and charging lines communicating with said sealed passageway intermediate said valve means and the opposite end of said passageway;

penetrating the penetrable wall of the refrigeration system through said open sealed passageway in said tool to open the refrigeration system to said sealed passageway via the access fitting;

moving said valve means to the position closing said passageway;

removing said end cap from said tool;

positioning a threaded closure member in said passageway adjacent to the opposite end thereof;

installing an end cap on said tool to sealingly engage the opposite end of said passageway moving said valve means to the position opening said passageway;

discharging the refrigerant from said compressor through said evacuating line;

charging the compressor with refrigerant through said charging lines;

moving said threaded closure member through said passageway to said access fitting; and threading said threaded closure member into sealing engagement with said access fitting.

11. The method as defined in claim 10 characterized further to include the additional step of:

removing said tool from said access fitting.

12. A method of servicing a sealed pressurized refrigeration system having an access fitting formed thereon in communication with a penetrable wall of said refrigeration system, with the access fitting being adapted to receive a threaded closure member in threaded sealing engagement therewith, employing evacuating means and refrigerant charging means, comprising the steps of:

sealingly engaging said access fitting with the first end of a tool having a sealed passageway formed therein and communicating with the first end of said tool and having a removable end cap sealingly engaging the opposite end of said passageway, and having valve means disposed in said passageway intermediate the first end of said tool and the opposite end of said passageway and movable between a position opening said passageway and a position closing said passageway;

penetrating the penetrable wall of the refrigeration system through said open sealed passageway in the tool to open said refrigeration system to said sealed passageway via said access fitting;

moving said valve means to the position closing said passageway;

removing said end cap from said tool;

connecting the opposite end of said passageway to said evacuating means and said refrigeration charging means;

moving said valve means to the position opening said passageway;

evacuating the refrigeration system through said passageway;

charging the evacuated refrigeration system with refrigerant through said passageway;

moving said valve means to the position closing said passageway;

disconnecting said evacuating means and said refrigerant charging means from the opposite end of said passageway;

positioning a threaded closure member in said passageway;

installing an end cap on said tool to sealingly engage the opposite end of said passageway;

moving said valve means to the position opening said passageway;

moving said threaded closure member through said passageway to said access fitting; and threading said threaded closure member into sealing engagement with said access fitting.

13. The method as defined in claim 12 characterized further to include the additional step of:

removing said tool from said access fitting.

14. A tool for use in maintaining and servicing a conventional sealed refrigeration system equipped with an internally and externally threaded access fitting adapted to receive a removable threaded closure member therein and secured in communication with and in substantially normal alignment with a penetrable wall of the sealed refrigeration system, comprising:

a body member having a first end, a second end and having a longitudinal passageway extending therethrough communicating at the opposite ends thereof with the first and second ends of said body member;

coupling means carried on the first end of said body member for removably connecting the first end of said body member to said access fitting with one end of said longitudinal passageway in sealing communication with the access fitting;

first removable cap means securable to the second end of said body member for sealing closure of the opposite end of said longitudinal passageway, and, alternately, for removal from said body member, and including an aperture formed therein substantially coaxial with the longitudinal passageway;

an externally threaded surface formed on said first removable cap means remote from the second end of said body member and coaxial with the aperture formed therein;

a first operating shaft having a first end and a second end and extending through said aperture in said first removable cap means, with the first end thereof disposed within said longitudinal passageway and with the second end thereof disposed outside said longitudinal passageway;

means carried by said first removable cap means for providing slidingly and rotatingly sealing engagement between said aperture in said first cap means and said first operating shaft so that said first operating shaft may be moved axially and rotatably within said longitudinal passageway;

a substantially conical point formed on the first end of said first operating shaft for penetrating the penetrable wall of said sealed refrigeration system to open the interior of said sealed refrigeration system to the interior of said access fitting;

control means operatively engaging the second end of said first operating shaft for threadedly engaging the external threads of said first removable cap means and for rotating and axially displacing said substantially conical point within said longitudinal passageway and the interior of said access fitting in response to stimulus external thereto;

second removable cap means securable to the second end of said body member in alternation with said first removable cap means for sealing closure of the opposite end of said longitudinal passageway, and, alternately, for removal from said body member, and including an aperture formed therein substantially coaxial with the longitudinal passageway;

a second operating shaft having a first end and a second end and extending through said aperture in said second removable cap means, with the first end thereof disposed within said longitudinal passageway and with the second end thereof disposed outside said longitudinal passageway;

means carried by said second removable cap means for providing slidingly and rotatingly sealing engagement between said aperture in said second cap means and said second operating shaft so that said second operating shaft may be moved axially and rotatably within said longitudinal passageway;

engaging means secured to the first end of said second operating shaft for releasably engaging and retaining said removable threaded closure member during installation and removal of said threaded closure member in and from said access fitting;

control means operatively engaging the second end of said second operating shaft for rotating and axially displacing said engaging means within said longitudinal passageway in response to stimulus external thereto;

valve means carried by said body member intermediate the first and second ends thereof for alternately opening and closing said longitudinal passageway, said valve means being adapted to close said longitudinal passageway when said operating shafts are displaced toward the second end of said body member, said valve means including:

a valve fitting formed on said body member and extending laterally therefrom;

a lateral cylindrical bore extending through said valve fitting and a portion of said body member and communicating between said longitudinal passageway and the outer end of said valve fitting;

a valve stem having a first end portion and a second end portion, with the first end portion thereof disposed within said lateral bore and with the second end portion extending beyond the outer end of said valve fitting;

actuating means operatively engaging the second end portion of said valve stem for moving said valve means between a first position opening and a second position closing said longitudinal passageway in response to external force applied thereto; external threads formed on said valve stem intermediate the first and second end portions;

valve cap means threadedly engaged with said external threads of said valve stem for securing said valve stem to said valve fitting so that rotation of said valve stem relative to said valve cap means and said valve fitting by said actuating means causes corresponding axial movement of said valve stem within said lateral bore;

resilient valve member means fixedly secured to and encircling the first end portion of said valve stem and extending a distance beyond the first end portion of said valve stem, said valve member means being slidably disposed within said lateral bore for moving between a first position within said lateral bore and opening said longitudinal passageway, and a second position within and closing said longitudinal passageway;

a pair of longitudinally spaced circumferential ribs formed on said valve stem with one of said ribs abutting said resilient valve member means, said ribs each having a diameter slightly less than the diameter of said lateral bore and slidingly disposed therein in all positions of said valve stem relative to said valve fitting; and annular resilient seal member means disposed between said circumferential ribs for providing a sliding fluidtight seal between said valve stem and said lateral bore in all positions of said valve stem relative to said valve fitting.

15. The tool defined in claim 14 characterized further to include:

a laterally extending port formed in said body member intemediate said valve means and the second end of said body member and communicating between said longitudinal passageway and the exterior of said body member.

16. The tool as defined in claim 15 characterized further to include:

a Schrader-type valve core removably threadedly secured within said laterally extending port.

17. The tool as defined in claim 14 characterized further to include:

a laterally extending port formed in said body member intermediate the first and second ends thereof disposed opposite said valve fitting and aligned coaxial with said lateral bore extending through said valve fitting and communicating between said longitudinal passageway and the exterior of said body member.

18. The tool as defined in claim 17 characterized further to include:

a Schrader-type valve core removably threadedly secured within said laterally extending port.

* * * * *

PO-1050
(5/69)

UNITED STATES PATENT OFFICE
CERTIFICATE OF CORRECTION

Patent No. 3,935,713 Dated February 3, 1976

Inventor(s) John W. Olson

It is certified that error appears in the above-identified patent and that said Letters Patent are hereby corrected as shown below:

Column 3, line 12, "presnt" should be --present--.

Column 4, line 51 "thebifurcated" should be --the bifurcated--.

Column 6, line 25, "btween" should be --between--.

Column 6, line 57, "securd" should be --secured--.

Column 7, lines 29 and 30, "schrader" should be --Schrader--.

Column 9, line 45, "priphery" should be --periphery--.

Column 9, line 46, "periphery" should be --of--.

Column 11, line 17, "the", first occurrence, should be --and--.

Column 12, line 57, "alteration" should be --alternation--.

Column 13, line 6, "rotably" should be --rotatably--.

Column 13, line 63, after "valve", first occurrence, --stem-- should be added.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*